US009856569B2

(12) United States Patent
Bhavaraju

(10) Patent No.: US 9,856,569 B2
(45) Date of Patent: Jan. 2, 2018

(54) APPARATUS AND METHOD OF PRODUCING METAL IN A NASICON ELECTROLYTIC CELL

(71) Applicant: FIELD UPGRADING LIMITED, Calgary (CA)

(72) Inventor: Sai Bhavaraju, West Jordan, UT (US)

(73) Assignee: FIELD UPGRADING LIMITED, Calgary (CA)

( * ) Notice: Subject to any disclaimer, the term of this patent is extended or adjusted under 35 U.S.C. 154(b) by 110 days.

(21) Appl. No.: 13/935,035

(22) Filed: Jul. 3, 2013

(65) Prior Publication Data

US 2014/0008239 A1 Jan. 9, 2014

Related U.S. Application Data

(60) Provisional application No. 61/667,854, filed on Jul. 3, 2012.

(51) Int. Cl.

| | |
|---|---|
| ***C25C 1/22*** | (2006.01) |
| ***C25C 1/06*** | (2006.01) |
| ***C25C 3/06*** | (2006.01) |
| ***C25C 3/28*** | (2006.01) |
| ***C25B 1/14*** | (2006.01) |

(Continued)

(52) U.S. Cl.

CPC ..... *C25C 1/22* (2013.01); *C25B 1/14* (2013.01); *C25C 1/02* (2013.01); *C25C 1/06* (2013.01); *C25C 3/02* (2013.01); *C25C 3/06* (2013.01); *C25C 3/24* (2013.01); *C25C 3/28* (2013.01); *C25C 3/34* (2013.01)

(58) Field of Classification Search

CPC ..... C25C 3/28

See application file for complete search history.

(56) References Cited

U.S. PATENT DOCUMENTS 2,205,854 A * 6/1940 Kroll ..... 75/617
4,401,467 A * 8/1983 Jordan ..... 420/417

(Continued)

FOREIGN PATENT DOCUMENTS

EP 1726689 11/2006
GB 678807 9/1952

(Continued)

OTHER PUBLICATIONS

Schwandt et al, Determination of the kinetic pathway in electrochemical reduction oftitanium dioxide in molten calcium chloride, Electrochemica Acta, vol. 51, No. 1, Oct. 2005, pp. 66-76.*

(Continued)

*Primary Examiner* — Harry D Wilkins, III

(74) *Attorney, Agent, or Firm* — Foley & Lardner LLP

(57) ABSTRACT

A process of producing metal that includes adding a quantity of a alkoxide ($M(OR)_x$) or another metal salt to a cathode compartment of an electrolytic cell and electrolyzing the cell. This electrolyzing causes a quantity of alkali metal ions to migrate into the cathode compartment and react with the metal alkoxide, thereby producing metal and an alkali metal alkoxide. In some embodiments, the alkali metal is sodium such that the sodium ions will pass through a sodium ion selective membrane, such as a NaSICON membrane, into the cathode compartment.

18 Claims, 9 Drawing Sheets

(51) Int. Cl.

| | |
|---|---|
| ***C25C 1/02*** | (2006.01) |
| ***C25C 3/02*** | (2006.01) |
| ***C25C 3/24*** | (2006.01) |
| ***C25C 3/34*** | (2006.01) |

(56) References Cited

U.S. PATENT DOCUMENTS

| | | | | |
|---|---|---|---|---|
| 4,521,281 | A * | 6/1985 | Kadija | C25C 3/00 204/216 |
| 4,919,772 | A | 4/1990 | Bachot et al. | |
| 5,282,937 | A * | 2/1994 | Miller | C25C 3/02 204/243.1 |
| 5,580,430 | A | 12/1996 | Balagopal et al. | |
| 5,711,783 | A * | 1/1998 | Schloh | 75/362 |
| 6,235,183 | B1 * | 5/2001 | Putter | C25C 3/02 205/351 |
| 7,824,536 | B2 | 11/2010 | Balagopal et al. | |
| 7,918,986 | B2 | 4/2011 | Balagopal et al. | |
| 7,959,784 | B2 | 6/2011 | Balagopal et al. | |
| 2004/0050208 | A1 * | 3/2004 | Nie et al. | 75/369 |
| 2004/0237711 | A1 * | 12/2004 | Ono | C22B 34/1268 75/10.58 |
| 2005/0177008 | A1 * | 8/2005 | Balagopal | B01D 61/44 568/851 |
| 2006/0102489 | A1 | 5/2006 | Kelly | |
| 2006/0107790 | A1 * | 5/2006 | Anderson et al. | 75/351 |
| 2006/0144701 | A1 * | 7/2006 | Kelly | 204/267 |
| 2006/0213327 | A1 * | 9/2006 | Shekhter et al. | 75/346 |
| 2007/0181435 | A1 * | 8/2007 | Ogasawara et al. | 205/366 |
| 2011/0135565 | A1 * | 6/2011 | Bingham et al. | 423/657 |
| 2011/0209294 | A1 * | 9/2011 | Choi | 8/550 |
| 2011/0259736 | A1 | 10/2011 | Balagopal et al. | |

FOREIGN PATENT DOCUMENTS

| | | | |
|---|---|---|---|
| JP | 2000-080491 | A * | 3/2000 |
| JP | 2000086225 | | 3/2000 |
| WO | WO2005103338 | | 11/2005 |

OTHER PUBLICATIONS

"Standard Reduction Potentials", obtained at https://www.av8n.com/physics/redpot.htm on Jan. 12, 2016.*

S.N. Flengas, Solubilities of Titanium Tetrachloride in Mixtures of Potassium Chloride and Sodium Chloride, and the Electrode Potentials of the Titanium Chlorides in 1/1 (Mole) KCl—NaCl Solutions, Annals of the New York Academy of Sciences, Jan. 1960, vol. 79, No. 11, pp. 853-872.*

Machine Translation of Karita et al JP 2000-080491 A from EPO.*

Machine Translation of Karita et al JP 2000-086225 A from EPO.*

Lee, Jong K., "International Search Report", PCT Application No. PCT/US13/049345 (Corresponding to U.S. Appl. No. 13/935,035), (dated Dec. 9, 2013),1-4.

Lee, Jong K., "Written Opinion of the International Searching Authority", PCT Application No. PCT/US13/049345 (Corresponding to U.S. Appl. No. 13/935,035), (dated Dec. 9, 2013),1-9.

Hammerstein, G , "European Search Report", EP Patent Application No. 13813300.4, dated Dec. 3, 2015, 1-7.

Katsuichi, Iwata , "English Language Patent Abstract", Japanese Patent Application No. 13813300.4, dated Mar. 28, 2000, 1.

* cited by examiner

APPARATUS AND METHOD OF PRODUCING METAL IN A NASICON ELECTROLYTIC CELL

CROSS-REFERENCE TO RELATED APPLICATION

This application claims the benefit of U.S. Provisional Patent Application No. 61/667,854 filed on Jul. 3, 2012 entitled "Apparatus and Method of Producing Titanium Metal in a Nasicon Electrolytic Cell." This provisional patent application is expressly incorporated herein by reference.

TECHNICAL FIELD

The present invention relates to the production of metals. More specifically, the present invention relates to a method of producing titanium or a rare earth metal using an electrolytic reaction within an electrolytic cell.

BACKGROUND

Rare earth metals and metals such as Titanium metal (Ti) are highly desirable products that are used in many commercial products. Titanium is desirable in that it has a high strength-to-weight ratio. Thus, titanium may be used to form products that are relatively light-weight, but still have a high strength. In its unalloyed form, titanium is as strong as some steel materials, yet can be significantly lighter than steel. However, titanium metal can be expensive to make as it generally involves reducing minerals such as rutile ($TiO_2$) into titanium metal.

Accordingly, there is a need in the industry for a new type of method and apparatus for producing titanium and other rare earth metals. Such a method and apparatus is disclosed herein.

SUMMARY

This invention relates to producing titanium and other metals (such as rare earth metals) in an electrolytic cell. With respect to producing Ti, a supply of $TiO_2$ is obtained. This $TiO_2$ material may be in the form of rutile, anatase or brookite, which are all known minerals containing $TiO_2$. Generally, rutile is the most common form of $TiO_2$. The $TiO_2$ may then be converted into $TiCl_4$ through the addition of acid (such as, for example, hydrochloric acid.) Water is also formed in this reaction. Those skilled in the art will appreciate how to form $TiCl_4$ from $TiO_2$.

Once $TiCl_4$ has been formed, this material may be reacted to form a titanium alkoxide product. This generally occurs by the following reaction which forms an alkali metal chloride (such as, for example, sodium chloride):

$$\underset{\text{(titanium chloride)}}{TiCl_4} + \underset{\text{(sodium alkoxide)}}{4\,Na(OR)} \longrightarrow \underset{\text{(titanium alkoxide)}}{Ti(OR)_4} + \underset{\text{(salt)}}{4\,NaCl}$$

Although sodium is shown in the above reaction, other alkali metal salts or alloy may also be used.

Titanium chloride is a difficult component to work with as it is highly acidic and corrosive. Accordingly, by converting the titanium chloride into a titanium alkoxide product, the reaction materials are much easier to work with. In some embodiments, the alkoxide may be methoxide $(OCH_3)^-$ such that the titanium alkoxide is titanium methoxide ($Ti(OCH_3)_4$).

Once the titanium alkoxide is formed, it may be placed in the cathode compartment of an electrolytic cell. The anode compartment has a supply of alkali metal ions (such as sodium ions). (In some embodiments, the alkali metal ions may be produced in the anode compartment.) The sodium ions migrate across a sodium selective membrane (such as a NaSICON membrane) and enter the cathode compartment. While in the cathode compartment, the sodium ions will react with the titanium alkoxide to form titanium metal ions (which may be electrolytically reduced and plated onto the electrode) and sodium alkoxide. By forming sodium alkoxide in the cell, a quantity of sodium alkoxide may be recovered and reused to react with another quantity of $TiCl_4$ thus closing the sodium loop Thus, another quantity of sodium alkoxide does not need to be re-purchased in order to perform the reaction again.

With respect to formation of rare earth metals, similar embodiments may be constructed in which alkali ions (such as sodium ions) transport across the membrane and react with rare earth ion salts in the cathode, in the manner described above to form free rare earth ions. The rare earth ions are electrolytically reduced at the electrode to form the rare earth metal which will plate onto the electrode, thereby recovering such materials for future use.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
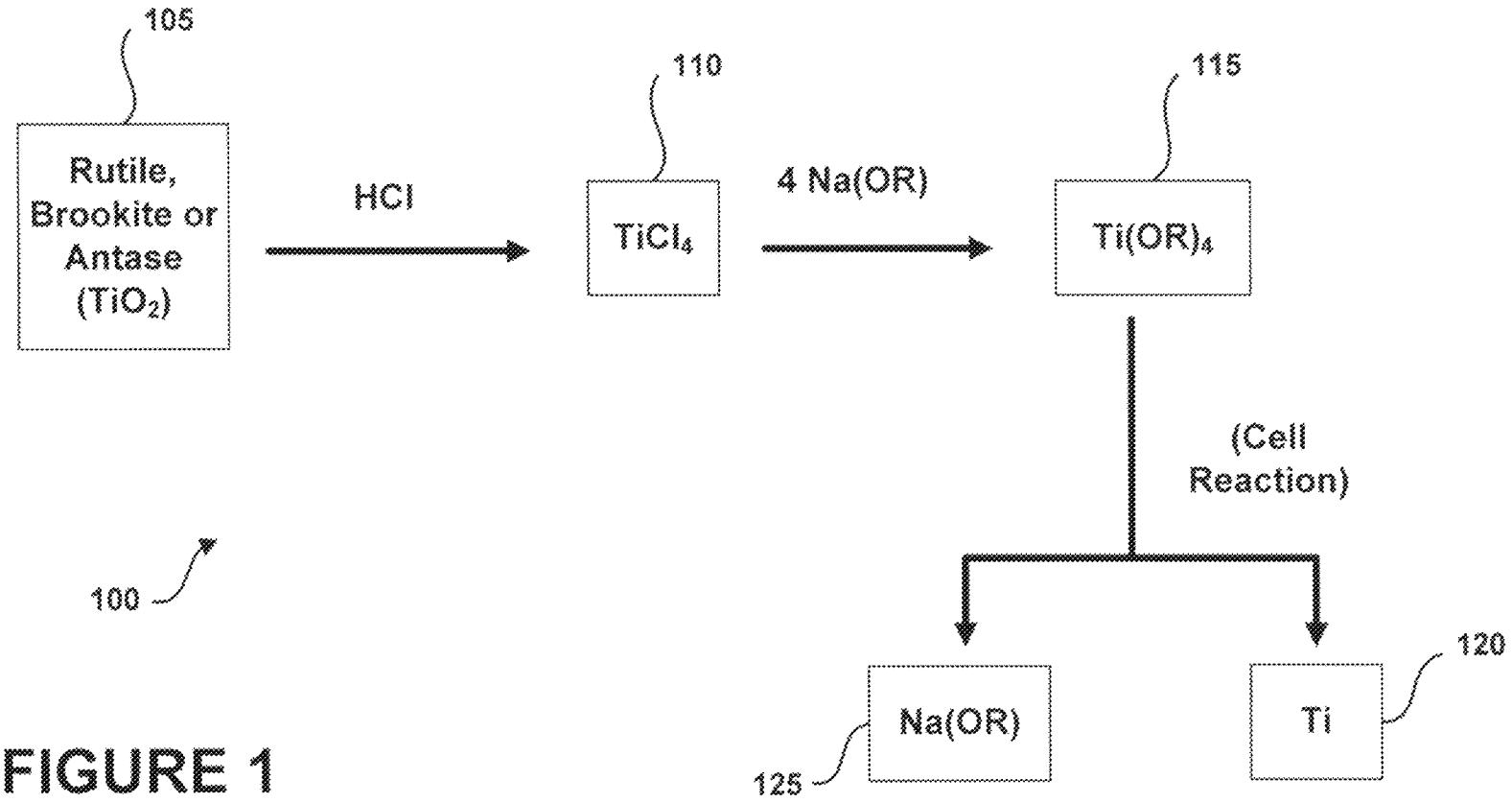
FIG. 1 is a schematic diagram illustrating an embodiment of a method for producing titanium metal.

Referring now to FIG. 1, a schematic flow diagram shows the chemical reactions that occur according to the present embodiments. Specifically, FIG. 1 shows a method 100 for producing a quantity of titanium metal. A quantity of $TiO_2$ 105 is obtained. This quantity of $TiO_2$ 105 may be based upon/obtained from rutile, brookite or anatase minerals. $TiO_2$ from other sources may also be used. The quantity of $TiO_2$ 105 may be reacted with HCl or another acid to form $TiCl_4$ 110. Those skilled in the art will appreciate the reaction conditions that are necessary to create the $TiCl_4$ 110. Of course, other acids, such as HBr or HI could be used to react with the $TiO_2$, thereby forming $TiBr_4$ or $TiI_4$.

The $TiCl_4$ 110 may be reacted with a quantity of an alkali metal alkoxide to form $Ti(OR)_4$ 115. The alkali metal alkoxide may be a sodium salt. Non-limiting examples of the alkali metal alkoxide that may be used include sodium methylate, sodium ethoxide, sodium isopropoxide, etc. (Of course, lithium salts, potassium salts of the alkoxides may also be used.) In a preferred embodiment the $Ti(OR)_4$ 115 may comprise $Ti(OCH_3)_4$, $Ti(OCH_2CH_3)_4$, or $Ti(OCH(CH_3)_2)_4$.

The $Ti(OR)_4$ 115 may then be reacted in an electrolytic cell as will be described in greater detail herein. The electrolytic cell operates to form a quantity of titanium metal 120. The cell reaction will also produce a quantity of the alkali metal alkoxide 125 (such as, for example, sodium alkoxide). This quantity of the alkali metal alkoxide 125 may then be used/re-reacted with another quantity of $TiCl_4$. Thus, the cell operates to regenerate the alkali metal alkoxide 125 such that a new batch/supply of the alkali metal alkoxide does not need to be purchased if the reaction is to be repeated. (In other words, the system acts as a "closed loop system" that regenerates some of the needed reactants.) It will be appreciated that the process may be used for other metals such as rare earth metals, including without limitation Cerium, Yttrium, Neodymium and the like. In these embodiments, the metal alkoxide may be $M(OR)_x$ where M is a metal. The $M(OR)_x$ may comprise $M(OCH_3)_x$, $M(OCH_2CH_3)_x$, or $M(OCH(CH_3)_2)_x$ (where X is the number that provides the stoichiometric balance of the M cation).

Figure 2:
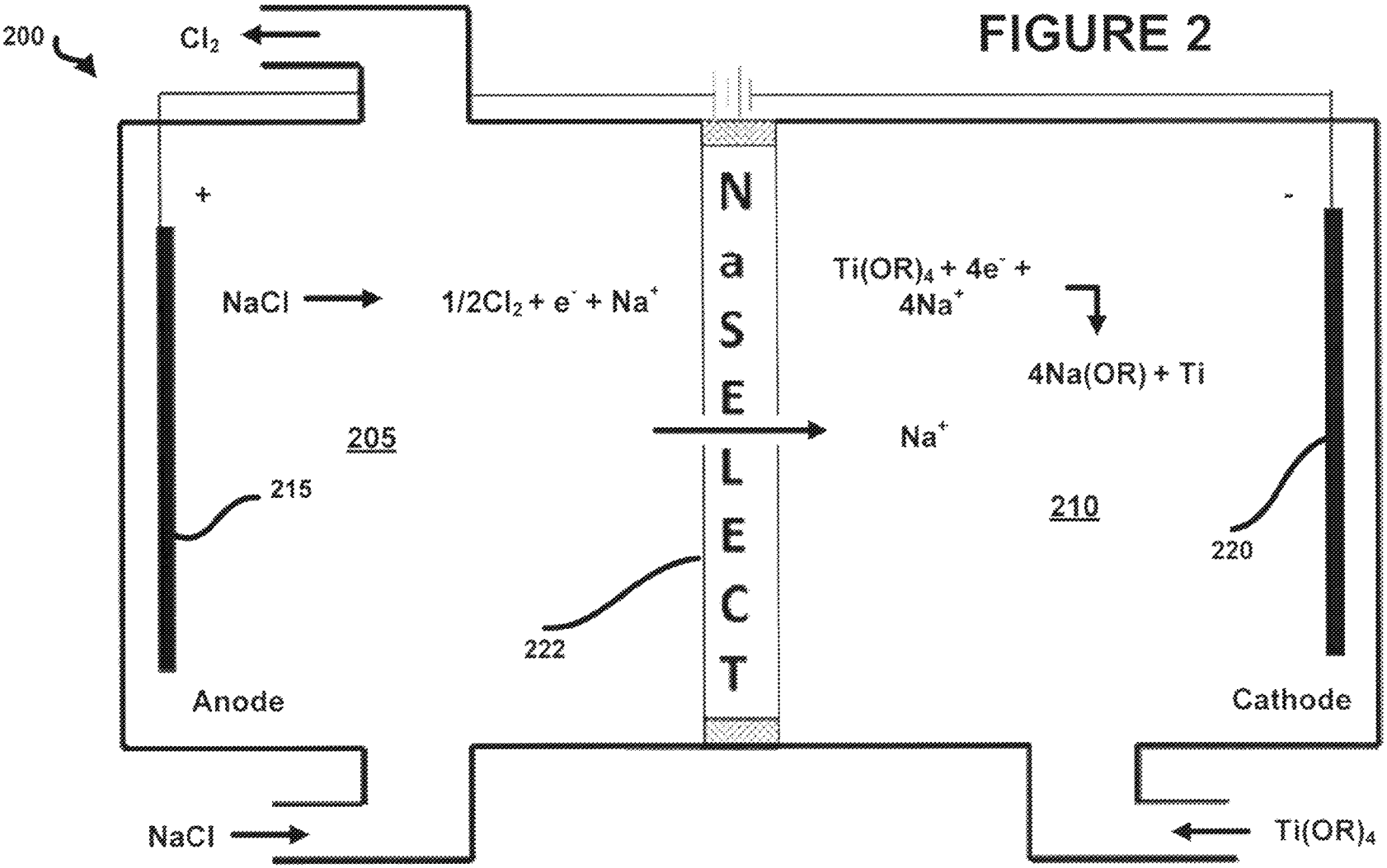
FIG. 2 is a schematic drawing of an embodiment of an electrolytic cell that may be used to produce titanium metal.

Referring now to FIG. 2, a schematic diagram is shown of a cell 200 that may be used to implement the method of the present embodiments. The cell 200 is a two-compartment cell having an anode compartment 205 and a cathode compartment 210. The cathode compartment 210 includes a cathode 220 and the anode compartment 205 includes an anode 215. The two compartments 205, 210 are separated by an ion selective membrane 222. In one embodiment, the ion selective membrane 222 is a sodium super ion conductive membrane, sometimes referred to as NaSICON. In another embodiment, the ion selective membrane 222 is beta alumina. In some embodiments, the cathode 220 may be a current collector.

The electrode materials used for the anode 215 and the cathode 220 are preferably good electrical conductors and should be stable in the media to which they are exposed. Any suitable material may be used, and the material may be solid or plated, or perforated or expanded. One suitable anode material is a dimensionally stable anode (DSA) which is comprised of ruthenium oxide coated titanium ($RuO_2$/Ti). Good anodes can also be formed from nickel, cobalt, nickel tungstate, nickel titanate, platinum and other noble anode metals, as solids plated on a substrate, such as platinum-plated titanium or Kovar. Stainless steel, lead, graphite, tungsten carbide and titanium diboride are also useful anode materials.

Good cathodes can be formed from metals such as copper, nickel, titanium, steel, platinum as well as other materials. The cathode material may be designed such as a plate, mesh wool, 3-dimensional matrix structure or as "balls" in the cathode compartment 210. Those skilled in the art will appreciate that other materials may be used as the cathode. Some materials may be particularly designed to allow titanium metal to plate onto the cathode.

The membrane 222 that separates the compartments selectively transports a particular, desired cation species (such as sodium ions) from the anolyte to the catholyte side even in the presence of other cation species. The membrane is also significantly or essentially impermeable to water and/or other undesired metal cations. In accordance with preferred embodiments, ceramic NaSICON (Sodium Super Ionic Conductors) membrane compositions from Ceramatec, Inc. of Salt Lake City, Utah, may be used as the membrane 222. Preferred stiochiometric and non-stiochiometric NaSICON type (sodium super ion conductor) materials, such as those having the formula for example $M^1M^2A(BO_4)_3$ where $M^1$ and $M^2$ are independently chosen from Li, Na, and K, and where A and B include metals and main group elements, analogs of NaSICON have an advantage over beta alumina and other sodium ion-conductors.

As noted above, in a preferred embodiment, the cation conducted by the membrane is the sodium ion ($Na^+$). Preferred sodium ion conducting ceramic membranes include a series of NaSICON membrane compositions and membrane types outlined in U.S. Pat. No. 5,580,430. Such membranes are available commercially from Ceramatec, Inc. of Salt Lake City, Utah. Analogs of NaSICON to transportions such as Li and K, to produce other alkali alcoholates/materials are also developed at Ceramatec, Inc. These ion conducting NaSICON membranes are particularly useful in electrolytic systems for simultaneous production of alkali alcoholates, by electrolysis of an alkali (e.g., sodium) salt solution. Other patents that describe additional types of usable NaSICON membranes include U.S. Pat. Nos. 7,918,986, 7,824,536, 7,959,784 as well as U.S. Patent Application Publication No. 2011/0259736. (All of the patents and patent documents noted herein are expressly incorporated by reference.)

While the ceramic materials disclosed herein encompass or include many formulations of NaSICON materials, this disclosure concentrates on an examination of NaSICON-type materials for the sake of simplicity. The focused discussion of NaSICON-type materials as one example of materials is not, however, intended to limit the scope of the invention. For example, the materials disclosed herein as being highly conductive and having high selectivity include those metal super ion conducting materials that are capable of transporting or conducting any alkali cation, such as sodium (Na), lithium (Li), potassium (K), ions for producing alkali alcoholates. Membranes of NaSICON types may be formed by ceramic processing methods such as those known in the art. Such membranes may be in the form of very thin sheets supported on porous ceramic substrates, or in the form of thicker sheets (plates) or tubes Preferred ceramic membranes include the ceramic NaSICON type membranes include those having the formula $NaM_2(BO_4)_3$ and those having the formula $M^1M^2A(BO_4)_3$, but also including compositions of stiochiometric substitutions where $M^1$ and $M^2$ are independently chosen to form alkali analogs of NaSICON. Substitution at different structural sites in the above formula at $M^1$, $M^2$, A, and B may be filled by the 2+, 3+, 4+, 5+ valency elements. Other suitable alkali ion conductor ceramic materials have the formula: $M_{1+x}A_{2-x}N_yB_xC_{3-x}O_{12}$ ($0<x<2$) ($0<y<2$), where $M^1M^2$=Li, Na, K, and non-stoichiometric compositions, in the above formulation with substitution at different structural sites in the above formula $M^1$, $M^2$, A, N, B and C by the 2+, 3+, 4+, 5+ valency elements.

The membrane may have flat plate geometry, tubular geometry, or supported geometry. The solid membrane may be sandwiched between two pockets, made of a chemically-resistant HDPE plastic and sealed, preferably by compression loading using a suitable gasket or o-ring, such as an EPDM o-ring.

As shown in FIG. 2, a quantity of $Ti(OR)_4$ dissolved in an appropriate solvent may be added to the cathode compartment 210. This quantity of $Ti(OR)_4$ may be produced in the manner described herein. Further, a quantity of a sodium salt, such as sodium chloride, may be added as an aqueous solution or in the form of molten salt ($NaAlCl_4$) to the anode compartment 205. The sodium salt will react at the anode to form chlorine gas and electrons. In turn, the sodium ions may be transported across the membrane 222 into the cathode compartment 210 (as indicated by the arrow in FIG. 2). Once in the cathode compartment, the sodium ions may react with the $Ti(OR)_4$ to form titanium metal ions (that may be electrolytically reduced and plated on the electrode). The quantity of sodium alkoxide that may be collected and used to react with another supply of $TiCl_4$.

Figure 3:
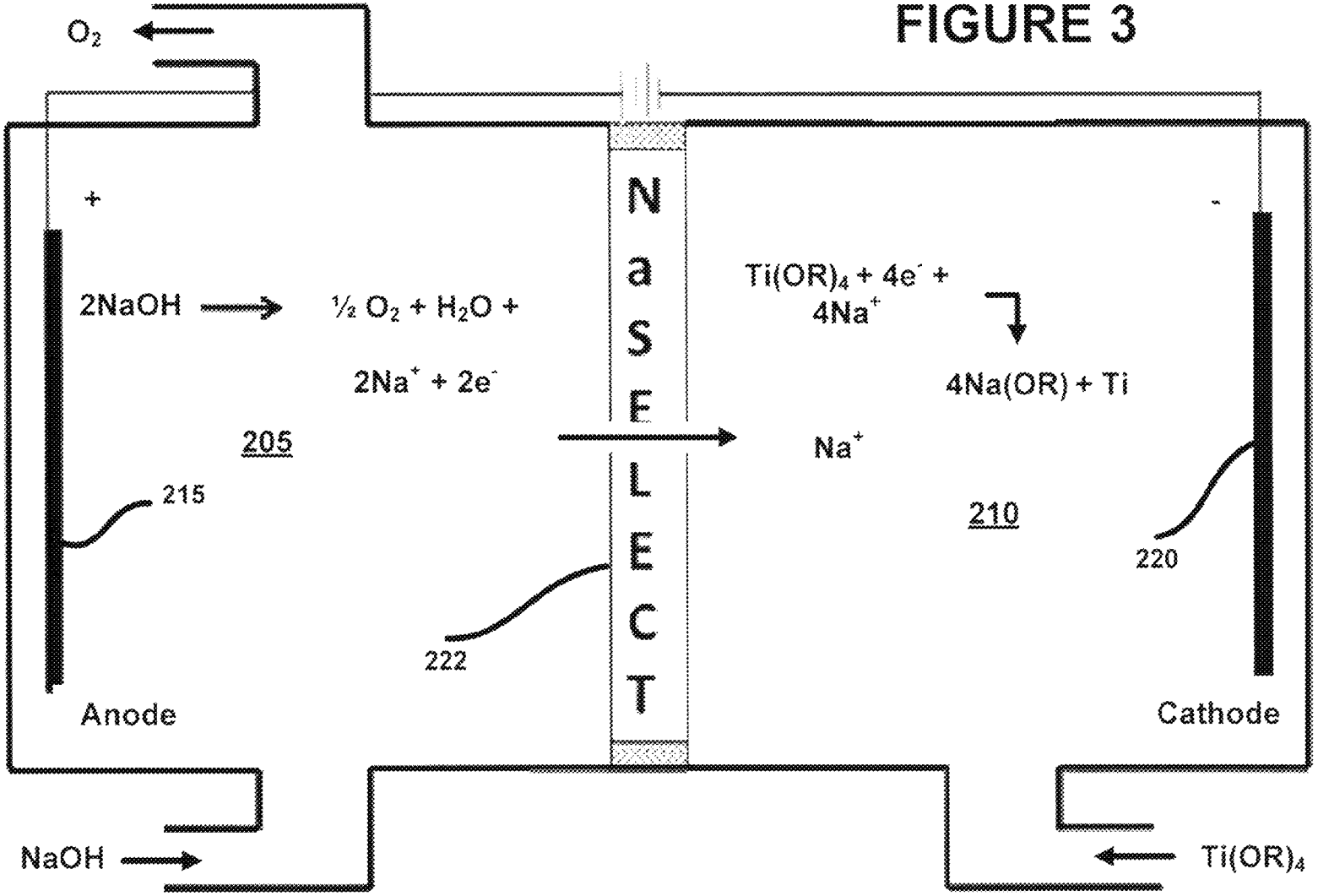
FIG. 3 is a schematic drawing of another embodiment of an electrolytic cell that may be used to produce titanium metal.

It should be noted that the sodium salt that is added to the anode compartment does not have to be sodium chloride. In fact, when sodium chloride is used, chlorine gas may be produced, which is corrosive and difficult to work with. Thus, other sodium salts instead of sodium chloride may be used on the anode side. For example, in the embodiment shown in FIG. 3, the sodium salt is sodium hydroxide. In the cell of FIG. 3, oxygen gas is produced, which is less toxic than chlorine gas. Other types of alkali metal salts may also be used in the anode reaction, such as alkali metal carbonates, alkali metal nitrates, alkali metal hydroxides, alkali metal sulfates, alkali metal acetates, etc.

It should be noted that $Ti(OR)_4$ typically dissolves in ROH. Accordingly, this solvent may be used in the cathode compartment. Other solvents may also be used such as ionic liquids, other types of alcohols, polyols, etc. Other organic solvents may also be used. With respect to the anode compartment, a different solvent than that which is used in the cathode compartment may be used. (Other embodiments may be designed in which the same solvent is used in both the anode and cathode compartments.) For example, water, an alcohol, etc. may be used as the solvent in the anode compartment. The membrane 222, such as the NaSICON membrane, is substantially stable with both aqueous and non-aqueous solvents. Thus, different solvents may be used in different parts of the cell without jeopardizing the stability of the NaSICON membrane.

It should be noted that when the Ti is formed in the cell, some small amounts of $TiO_2$ may also form, as a result of moisture being in the ROH solvent. Those skilled in the art will appreciate how to minimize the formation of $TiO_2$ in order to maximize the formation of Ti metal.

One of the advantages of the present cell is that it uses $Ti(OR)_4$ which is much less corrosive and difficult to work with than $TiCl_4$. However, $Ti(OR)_4$ is easily convertible to Ti metal, thus making the present reactions preferred. Moreover, as noted above, $TiBr_4$, $TiI_4$ or another Ti based material may be used instead of or in addition to $TiCl_4$.

Figure 4:
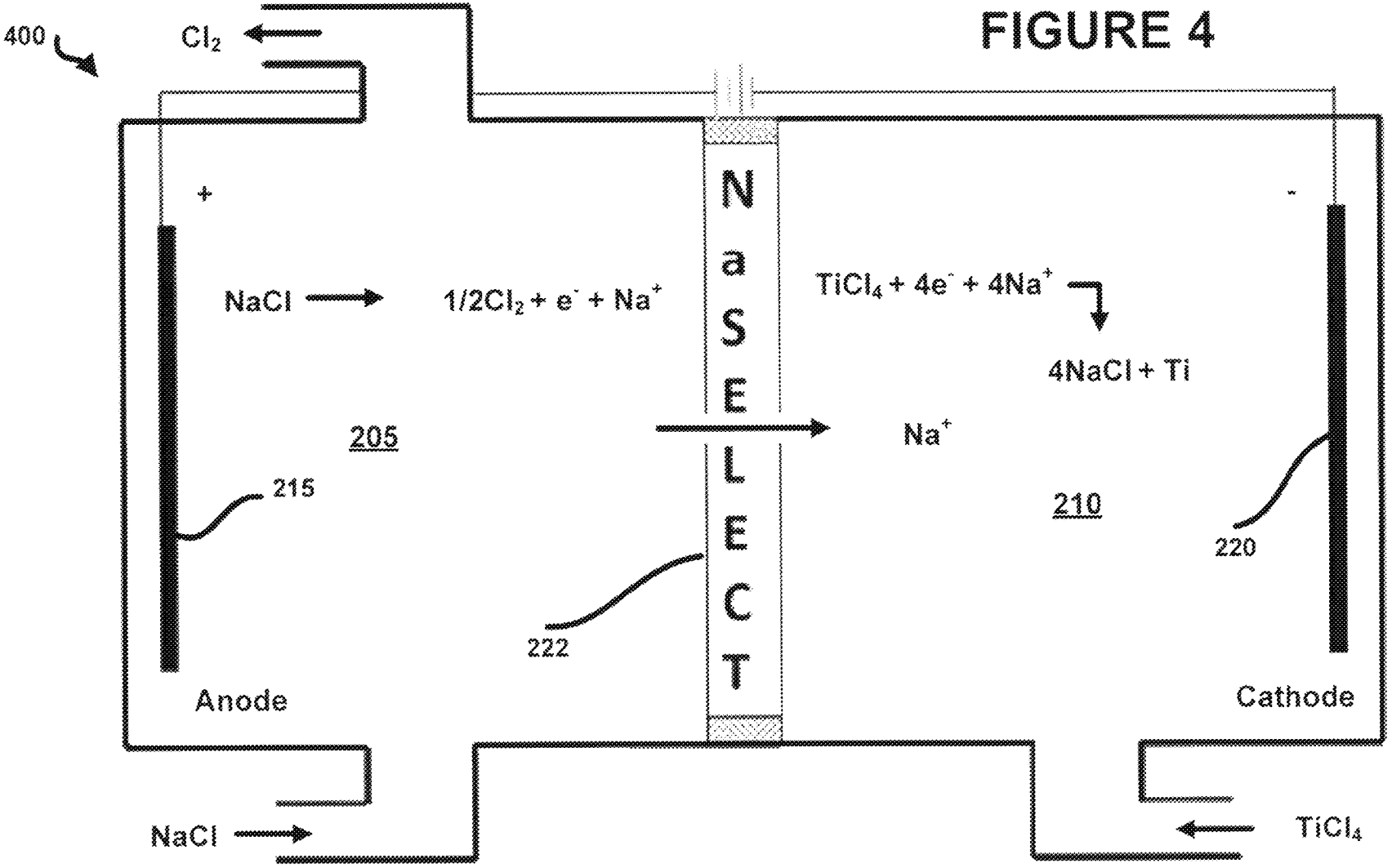
FIG. 4 is a schematic drawing of another embodiment of an electrolytic cell that may be used to produce titanium metal directly from $TiCl_4$.

Referring now to FIG. 4, a further embodiment of a cell 400 that is capable of producing titanium metal is illustrated. The cell 400 is similar to the cell 200 that was described in conjunction with FIG. 2. For purposes of brevity, much of this discussion will not be repeated.

The cell 400 is a two-compartment cell having an anode compartment 205 and a cathode compartment 210. The cathode compartment 210 includes a cathode 220 and the anode compartment 205 includes an anode 215. The two compartments 205, 210 are separated by an ion selective membrane 222. In one embodiment, the ion selective membrane 222 is a sodium super ion conductive membrane, sometimes referred to as NaSICON. In another embodiment, the ion selective membrane 222 is beta alumina. Any of the above-recited materials may be used as the membrane. Likewise, the cathode 220 and the anode 215 may be constructed of any of the materials outlined above. In the embodiment shown in FIG. 4, the alkali metal is sodium such that sodium ions will be transported from the anode compartment 205 to the cathode compartment 210.

As shown in FIG. 4, a quantity of $TiCl_4$ dissolved in appropriate solvent may be added to the cathode compartment 210. Unlike the embodiments described above in which the $TiCl_4$ has been reacted with a base to form $Ti(OR)_4$, the embodiment of FIG. 4 uses $TiCl_4$ itself in the cathode compartment 210. Although $TiCl_4$ may be more difficult (corrosive) to work with than $Ti(OR)_4$, embodiments may be constructed which use $TiCl_4$ or another Ti salt.

A quantity of a sodium salt, such as sodium chloride, may be added as an aqueous solution or in the form of molten salt ($NaAlCl_4$) to the anode compartment 205. The sodium salt will react at the anode to form chlorine gas and electrons. In turn, the sodium ions may be transported across the membrane 222 into the cathode compartment 210 (as indicated by the arrow in FIG. 2). Once in the cathode compartment, the sodium ions may react with the $TiCl_4$ to form titanium metal ions (that may be electrolytically reduced and plated on the electrode). Also formed is a quantity of sodium chloride.

It should be noted that the sodium salt that is added to the anode compartment does not have to be sodium chloride. In fact, when sodium chloride is used, chlorine gas may be produced, which is corrosive and difficult to work with. Thus, other sodium salts instead of sodium chloride may be used on the anode side, such as, for example, sodium hydroxide as shown in conjunction with FIG. 3.

Figure 5:
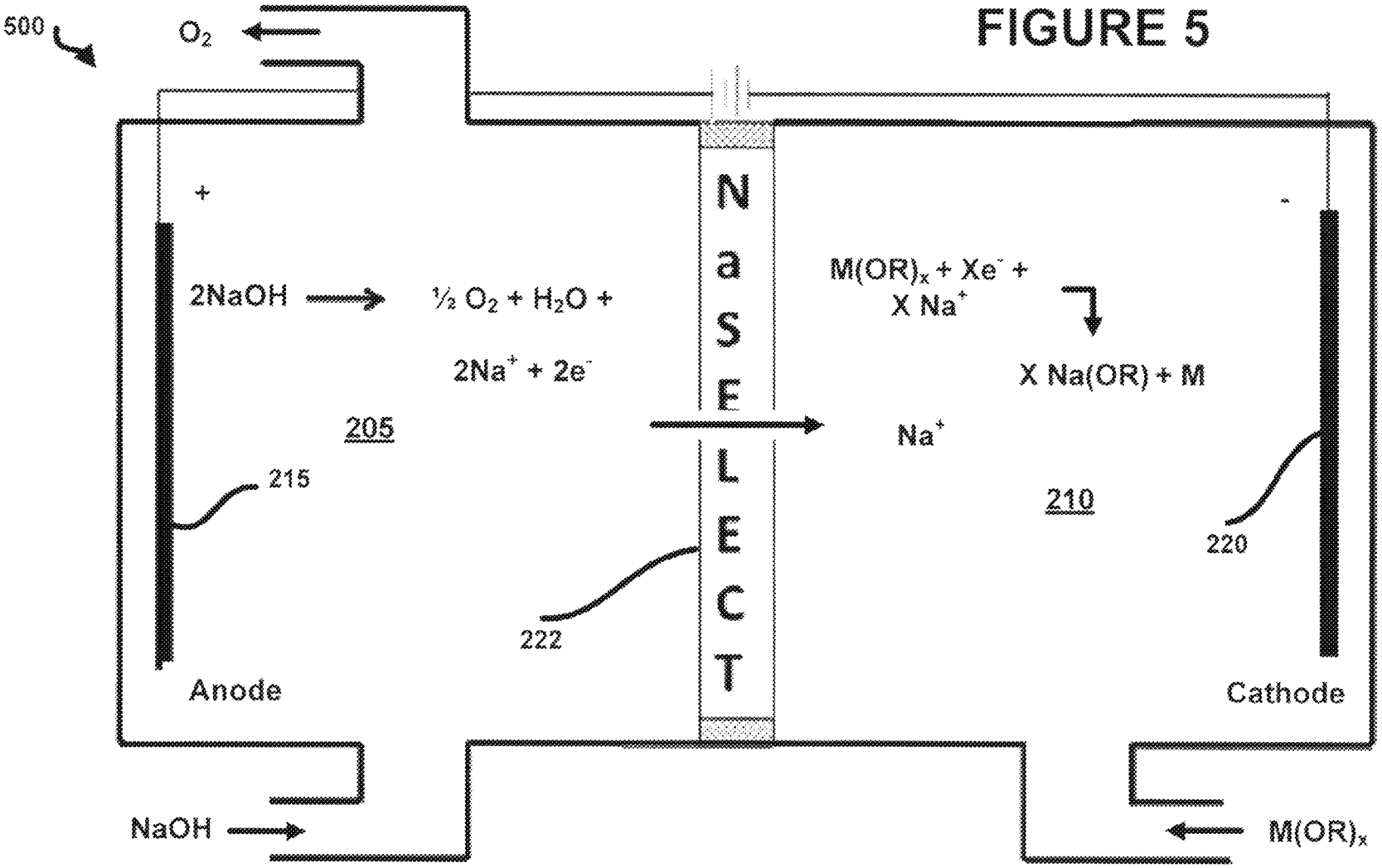
FIG. 5 is a schematic drawing of another embodiment of an electrolytic cell that may be used to produce a metal (M) (such as a rare earth metal)

Referring now to FIG. 5, a more general cell 500 is shown. The cell 500 is designed to product a quantity of a metal (M) from a metal alkoxide $M(OR)_X$. In some embodiments, the metal (M) may be Ti, such that the metal alkoxide is $Ti(OR)_4$. In other embodiments, the metal (M) may be another rare earth metal such as (without limitation) Cerium, Yttrium, Neodymium and the like. Of course, the particular oxidation state of the rare earth metal will depend upon how many molecules ("X") of alkoxide are needed for the stoichiometric balance in $M(OR)_X$.

It should be noted that the cell 500 is similar to the cell shown in FIG. 3 in which NaOH is used in the anode compartment 205 to produce a quantity of oxygen gas as part of the electrolytic reaction. Of course, other embodiments may be designed in which the anode compartment uses another component, such as sodium chloride shown in FIG. 4, or another sodium ion containing species.

During the electrolytic reaction, sodium ions will migrate across the NaSICON membrane and will enter the cathode compartment 210. The sodium ions will then react with the $M(OR)_x$ to form NaOR and a quantity of the metal ions ($M^{+x}$). Of course, other metal salts, instead of $M(OR)_x$ may also be used, such as, for example, $MCl_x$, $MBr_x$, $MI_x$, etc.

It should also be noted that the present embodiments may be constructed to produce aluminum metal or tantalum metal (in addition to Ce and/or Ti). For example, aluminum metal in this country is currently made via the Hall-Heroult electrolysis process, where aluminum oxide is dissolved in excess of molten cryolite ($Na_3AlF_6$) and is electrolyzed at a temperature of about 950° C. The electrolysis typically occurs at a voltage of 4 V and a current density of 800 mA/cm$^2$. However, production of aluminum by the Hall-Heroult method currently has high energy consumption because of the requirement of high temperature required to maintain the cryolite bath molten for electrolysis (nearly half of energy supplied to the electrolysis cell is used to produce heat in the cell). Also contributing to energy inefficiency is 40% of the total heat loss from the cells. Currently the most efficient U.S. primary aluminum production technologies require about 15 kilowatt hours per kilogram of aluminum (kWh/kg Al).

Figure 9:
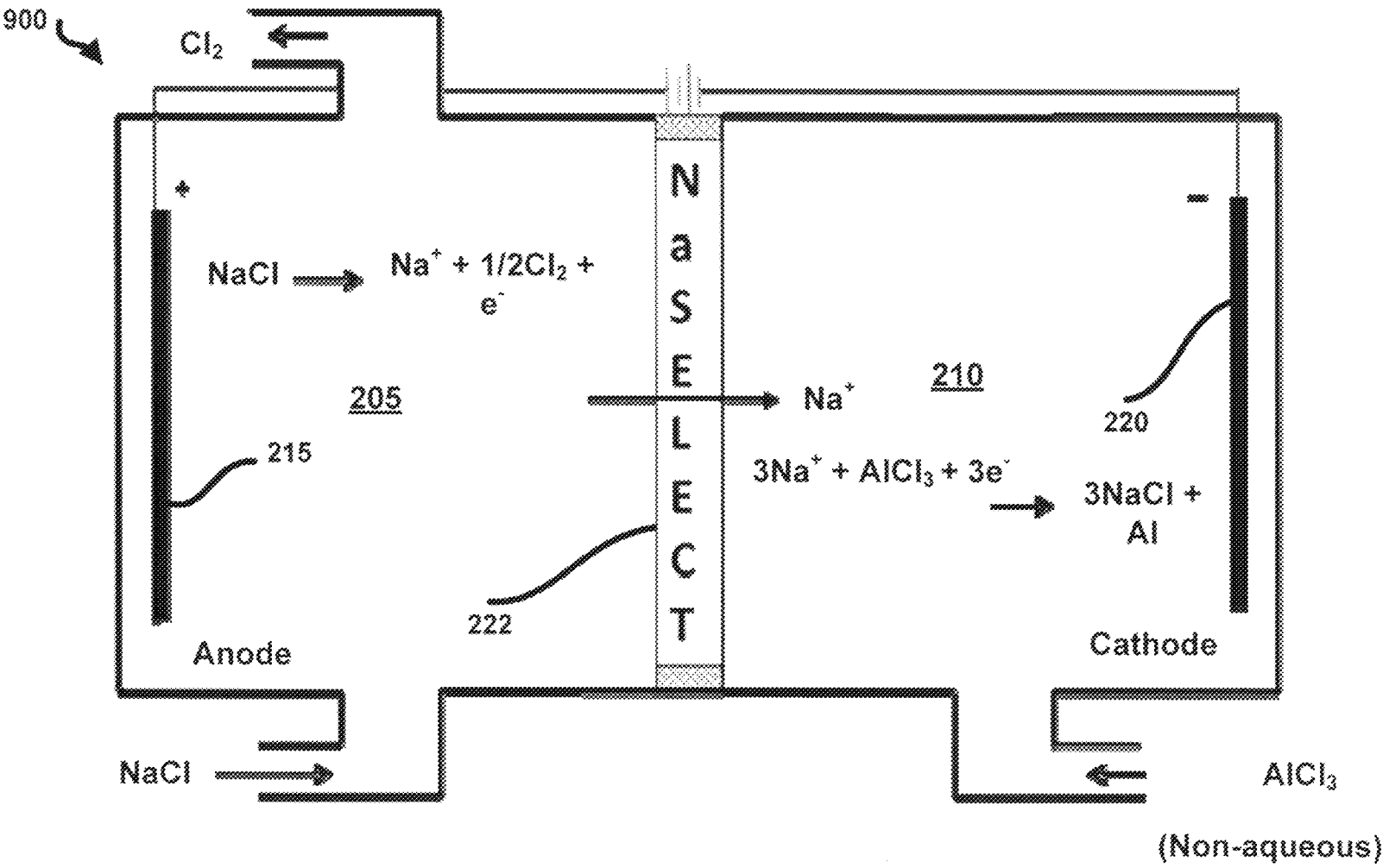
FIG. 9 shows another example of a cell that may be used to create aluminum according to the present embodiments.

Yet, the present embodiments could be made to make aluminum metal, and thus would obviate the need to use the high-energy Hall-Heroult method. For example, FIG. 9 shows a system 900 that may be used to create aluminum metal using the present embodiments. FIG. 9 shows the electrolysis cell that includes an anode 215 housed within an anode compartment 205. Likewise, in the embodiment of FIG. 9, a cathode 220 is housed within a cathode compartment 210. It includes a sodium ion conducting ceramic membrane 222 (which may be a NaSICON membrane). The ceramic membrane 222 separates the anolyte from a catholyte. In this embodiment, a sodium chloride stream is introduced into the anolyte compartment 205. Chlorine is generated from sodium chloride according to the following reaction:

$$3NaCl \text{----------}> 3/2Cl_2+3Na^++3e^-$$

Although, as noted in the above-recited embodiments, sodium hydroxide, sodium carbonate, etc. could be used as the anolyte.

The influence of the electric potential causes the sodium ions to pass through the ceramic membrane 222 from the anolyte compartment 205 to the catholyte compartment 210. The catholyte is a solution of aluminum trichloride dissolved in a non-aqueous solvent. An aluminum cathode is used, although other materials for the cathode 220 could be used. The following reduction reaction occurs at the cathode 220 to generate the Aluminum metal:

$$3Na^++AlCl_3+3e^- \text{----------}> 3NaCl+Al$$

Thus the sodium chloride used in the anolyte is regenerated in the catholyte and is simply recovered by filtration.

In the embodiment of FIG. 9, $AlCl_3$ is used as the aluminum salt. Those skilled in the art will appreciate that other aluminum salts may also be used in addition to or in lieu of aluminum chloride, including, for example, an aluminum alkoxide, aluminum iodide, aluminum bromide, or other ions (including any of the other ions outlined above).

One advantage of the embodiment of FIG. 9 is that the chlorine generated in the anode 215 can be used to produce HCl which in turn can be used to convert aluminum oxide to aluminum trichloride as follows:

$$6HCl+Al_2O_3 \rightarrow 2AlCl_3+3H_2O$$

Thus the same low cost starting material (alumina) as used in Hall-Heroult process is used in the embodiment of FIG. 9.

It should be noted that the embodiment of FIG. 9 may has significant advantages. For example, this cell may be run at low-temperatures—e.g., in the range of 25 to 110° C. Further, the cell typically operates at a low voltage of 4 volts and at current densities up to 100 to 150 mA per cm$^2$ of NaSelect membrane area. Energy consumption for the electrolysis in the cell 900 is projected to be in the range of 7.5 to 10 kWh/kg of Al, which is 36% to 50% lower energy consumed by the current technology. Thus, the cell 900 has the potential to displace the Hall-Héroult process and save significant energy for the U.S. aluminum industry.

Note that that the above methodology can be used in the production of other metals from the corresponding chlorides. Non-limiting examples include Cerium and Tantalum (in addition to Ti). For example, with respect to Cerium, Tantalum, Yttrium or Neodymium, salts of these metals (such as chloride salts, alkoxide salts, etc.) are placed in the cathode compartment 210. During electrolysis, these metal ions are reduced into their metallic form at the cathode 220, and sodium ions (or alkali metal ions) migrate through the membrane 222 from the anode compartment 205 to the cathode compartment 210. (The anode side of the cell may be of the type outlined herein). Of course, in this reaction, sodium alkoxide, sodium chloride, etc. may also be formed.

Examples

Tests have been conducted to regarding the ability to product Ti metal in a cell, according to the present embodiments. For example, a cell was prepared having a copper cathode and a nickel anode. The cell was a two-compartment cell, the cell being divided by a NASICON-GY membrane (e.g., a membrane that is commercially available from Ceramatec, Inc. of Salt Lake City, Utah. An anolyte was placed in the chamber housing the nickel anode. The anolyte comprising a 15% (by weight) aqueous solution of sodium hydroxide. A catholyte was placed in the compartment housing the copper cathode. The catholyte contained 3.1 grams of toluene mixed with 5 grams of a 1:1 molar ratio solution of sodium methoxide and titanium methoxide. (This 1:1 molar solution was created by mixing 1.2 grams of sodium methoxide and 3.8 grams of titanium methoxide.)

Figure 6:
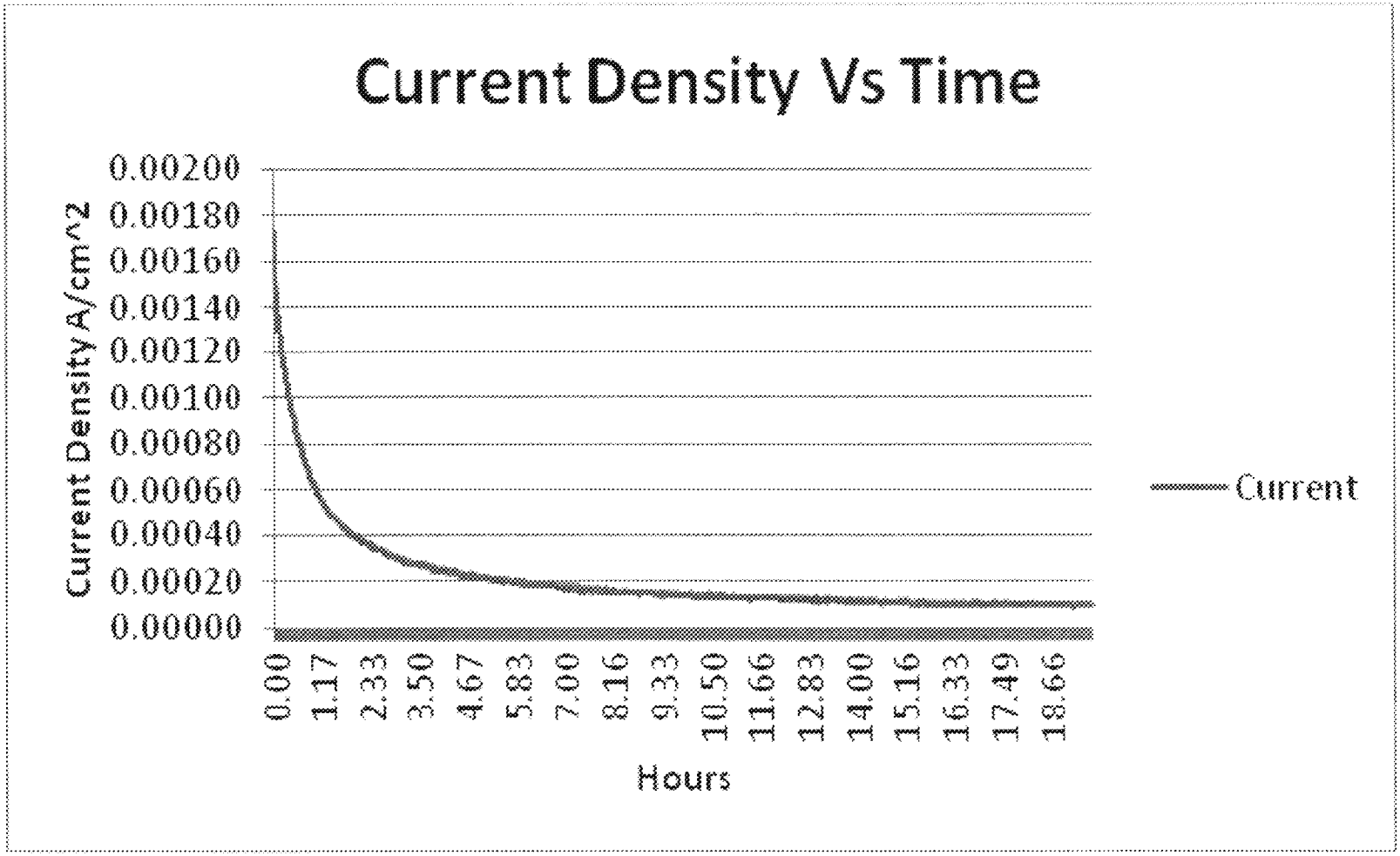
FIG. 6 shows a graph of current density versus time of a cell that plated Ti metal (from $Ti(OCH_3)_4$) on a Cu electrode.
Figure 7:
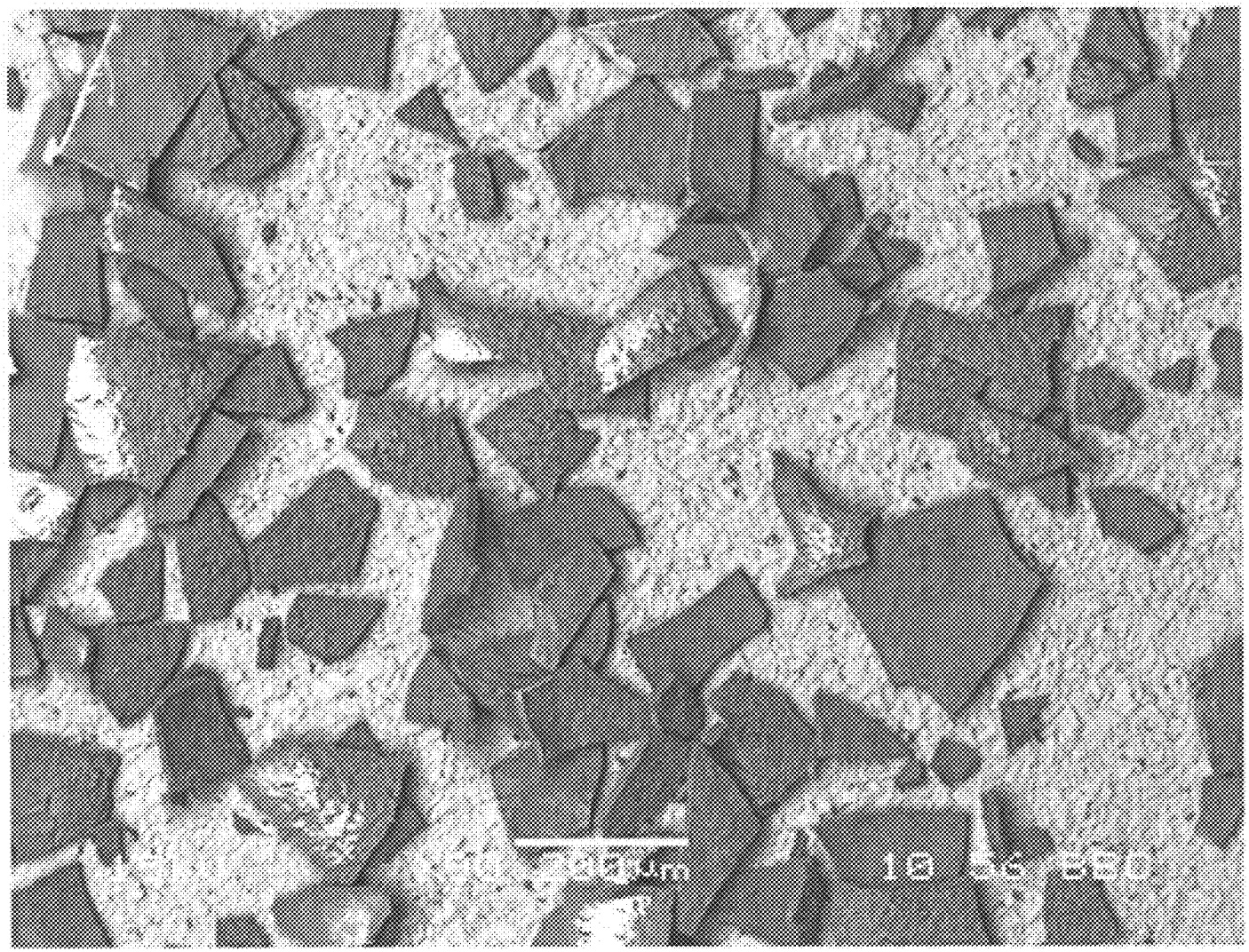
FIG. 7 shows a micrograph indicating that Cu metal had Ti deposited thereon.

To the above-constructed cell, a constant voltage of 15 volts (with variable current) was applied over the course of more than 18 hours. FIG. 6 shows a graph of the current density of this cell plotted versus time. As can be seen by FIG. 6, the current density drops very low over time, indicating that Ti metal was reduced and plated onto the Cu cathode. FIG. 7 shows a micrograph indicating that Cu metal had Ti deposited thereon, indicating that a cell of the type constructed herein will produce (plate) Ti onto the Cu.

Figure 8:
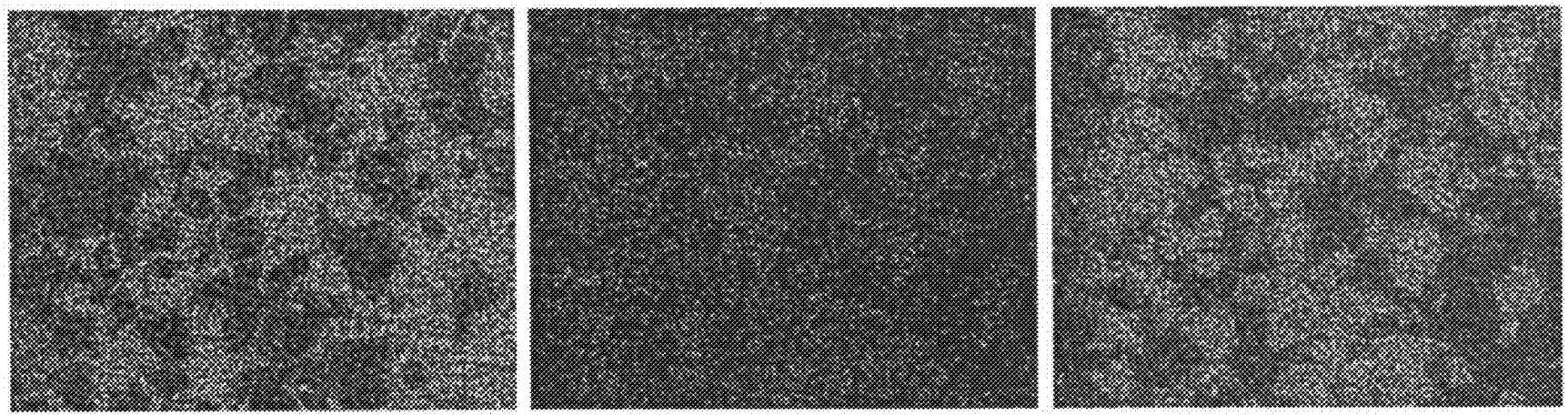
FIG. 8 shows EDX spectroscopy of plots of Cu, Carbon, and Ti on Cu.

FIG. 8 shows various EDX (energy-dispersive X-ray) spectroscopy plots of Cu, Carbon and Ti on Cu. (These plots are taken at energy level "K".) As shown, the Ti on Cu, the spectrum for Ti appears, rather than the spectrum for Cu, which indicates that the Ti was plated onto the Cu (and thus covers up the Cu). Accordingly, FIG. 8 shows that the Ti was indeed plated onto the Cu electrode.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method of producing titanium metal comprising:

adding a catholyte comprising a quantity of a titanium alkoxide ($Ti(OR)_4$) dissolved in a solvent to a cathode compartment of an electrolytic cell, wherein the solvent is selected from aqueous, ionic liquid, and organic solvents, and wherein the cathode compartment includes a cathode;

adding an anolyte comprising a quantity of alkali metal ions to an anode compartment of the electrolytic cell, wherein the anode compartment includes an anode;

separating the cathode compartment from the anode compartment with an alkali-ion selective membrane that allows alkali metal ions to migrate from the anode compartment to the cathode compartment while being significantly impermeable to other metal cations; and electrolyzing the cathode and anode of the electrolytic cell to electrolytically reduce titanium ions and cause titanium metal to plate onto the cathode and to cause alkali metal ions to migrate from the anode compartment into the cathode compartment and combine with alkoxide ions to form an alkali metal alkoxide.

2. The method of claim 1, wherein the alkali metal is sodium and the titanium alkoxide is titanium methoxide, wherein sodium ions migrate from the anode compartment into the cathode compartment when the cell is electrolyzed and combine with methoxide ions to form sodium methoxide.

3. The method of claim 1, wherein the titanium alkoxide ($Ti(OR)_4$) is obtained by reacting a quantity of titanium chloride ($TiCl_4$) with a quantity of a sodium alkoxide (NaOR).

4. The method of claim 1, wherein the alkali metal is sodium, wherein the quantity of sodium ions are obtained from a solution of sodium chloride or sodium hydroxide.

5. An electrolytic cell comprising:

a NaSICON membrane separating a cathode compartment and an anode compartment, wherein the cathode compartment comprises a cathode and the anode compartment comprises an anode and wherein the cathode and the anode are electrically connected to a source of electric potential;

a catholyte comprising a quantity of a titanium alkoxide ($Ti(OR)_4$) dissolved in a solvent disposed in the cathode compartment, wherein the solvent is selected from aqueous, ionic liquid, and organic solvents;

an anolyte comprising a quantity of sodium ions disposed in the anode compartment;

wherein the source of electric potential electrolyzes the cell and causes sodium ions to pass through the NaSICON membrane from the anode compartment into the cathode compartment and combine with alkoxide ions to form an alkali metal alkoxide, wherein the source of electric potential electrolytically reduces titanium ions and causes titanium metal to plate onto the cathode.

6. A method of producing titanium metal comprising:

adding a catholyte comprising a quantity of a $TiCl_4$ dissolved in a solvent to a cathode compartment of an electrolytic cell, wherein the solvent is selected from aqueous, ionic liquid, and organic solvents, and wherein the cathode compartment includes a cathode;

adding an anolyte comprising a quantity of alkali metal ions to an anode compartment of the electrolytic cell, wherein the anode compartment includes an anode;

separating the cathode compartment from the anode compartment with an alkali-ion selective membrane that allows alkali metal ions to migrate from the anode compartment to the cathode compartment while being significantly impermeable to other metal cations; and;

electrolyzing the cathode and anode of the electrolytic cell to electrolytically reduce titanium ions and cause titanium metal to plate onto the cathode and to cause alkali metal ions to migrate into the cathode compartment and combine with chloride ions to form an alkali metal chloride compound.

7. The method of claim 6, wherein the alkali metal is sodium, wherein sodium ions migrate from the anode compartment into the cathode compartment when the cell is electrolyzed and combine with chloride ions to form sodium chloride.

8. The method of claim 6, wherein the alkali metal is sodium, wherein the quantity of sodium ions are obtained from a solution of sodium chloride or sodium hydroxide.

9. An electrolytic cell comprising:

a NaSICON membrane separating a cathode compartment and an anode compartment, wherein the cathode compartment comprises a cathode and the anode compartment comprises an anode and wherein the cathode and the anode are electrically connected to a source of electric potential;

a catholyte comprising a quantity of a $TiCl_4$ dissolved in a solvent disposed in the cathode compartment, wherein the solvent is selected from aqueous, ionic liquid, and organic solvents;

an anolyte comprising a quantity of sodium ions disposed in the anode compartment;

wherein the source of electric potential electrolyzes the cell and causes sodium ions to pass through the NaSICON membrane from the anode compartment into the cathode compartment, wherein the source of electric potential electrolytically reduces titanium ions and causes titanium metal to plate onto the cathode, and wherein sodium ions combine with chloride ions to form sodium chloride.

10. A method of producing a metal (M) comprising:

adding a catholyte comprising a quantity of a metal (M) salt dissolved in a solvent to a cathode compartment of an electrolytic cell, wherein the solvent is selected from aqueous, ionic liquid, and organic solvents, and wherein the cathode compartment includes a cathode;

adding an anolyte comprising a quantity of alkali metal ions to an anode compartment of the electrolytic cell, wherein the anode compartment includes an anode;

separating the cathode compartment from the anode compartment with an alkali-ion selective membrane that allows alkali metal ions to migrate from the anode compartment to the cathode compartment while being significantly impermeable to other metal cations; and;

electrolyzing the cathode and anode of the electrolytic cell to electrolytically reduce metal (M) ions and cause metal (M) to plate onto the cathode and to cause alkali metal ions to migrate from the anode compartment into the cathode compartment.

11. The method of claim 10, wherein the alkali metal is sodium and the metal salt is a metal alkoxide, wherein sodium ions migrate from the anode compartment into the cathode compartment when the cell is electrolyzed and combine with alkoxide ions to form sodium alkoxide.

12. The method of claim 11, wherein the metal alkoxide ($M(OR)_x$) is obtained by reacting a quantity of metal chloride ($MCl_x$) with sodium alkoxide.

13. The method of claim 10, wherein the metal (M) is selected from the group comprising Cerium, Aluminum, Tantalum, Titanium, Yttrium, and Neodymium.

14. The method of claim 10, wherein the alkali metal is sodium, wherein the quantity of sodium ions are obtained from a solution of sodium chloride or sodium hydroxide.

15. An electrolytic cell comprising:

a NaSICON membrane separating a cathode compartment and an anode compartment, wherein the cathode compartment comprises a cathode and the anode compartment comprises an anode and wherein the cathode and the anode are electrically connected to a source of electric potential;

a catholyte comprising a quantity of a metal (M) salt dissolved in a solvent disposed in the cathode compartment, wherein the solvent is selected from aqueous, ionic liquid, and organic solvents;

an anolyte comprising a quantity of sodium ions disposed in the anode compartment;

wherein the source of electric potential electrolyzes the cell and causes sodium ions to pass through the NaSICON membrane from the anode compartment into the cathode compartment, wherein the source of electric potential electrolytically reduces metal (M) ions and causes metal (M) to plate onto the cathode.

16. An electrolytic cell comprising:

a NaSICON membrane separating a cathode compartment and an anode compartment, wherein the cathode compartment comprises a cathode and the anode compartment comprises an anode and wherein the cathode and the anode are electrically connected to a source of electric potential;

a catholyte comprising a quantity of a metal (M) salt comprising an alkoxide, chloride, bromide or iodide salt of one of the following metals (M): Cerium, Aluminum, Tantalum, Titanium, Yttrium, and Neodymium, wherein the metal (M) salt is dissolved in a solvent and disposed in the cathode compartment, wherein the solvent is selected from aqueous, ionic liquid, and organic solvents;

an anolyte comprising a quantity of sodium ions disposed in the anode compartment;

wherein the source of electric potential electrolyzes the cell and causes sodium ions to pass through the NaSICON membrane from the anode compartment into the cathode compartment, wherein the source of electric potential electrolytically reduces metal (M) ions and causes metal (M) to plate onto the cathode, and wherein sodium ions combine with alkoxide, chloride, bromide or iodide ions to form sodium alkoxide, sodium chloride, sodium iodide or sodium bromide.

17. A method of producing aluminum metal comprising:

adding catholyte comprising a quantity of an aluminum salt dissolved in a solvent to a cathode compartment of an electrolytic cell, wherein the cathode compartment includes a cathode;

adding an anolyte comprising a quantity of alkali metal ions to an anode compartment of the electrolytic cell, wherein the anode compartment includes an anode;

separating the cathode compartment from the anode compartment with an alkali-ion selective membrane that allows alkali metal ions to migrate from the anode compartment to the cathode compartment while being significantly impermeable to other metal cations; and;

electrolyzing the cathode and anode of the electrolytic cell to electrolytically reduce aluminum ions and cause aluminum metal to plate onto the cathode and to cause alkali metal ions to migrate from the anode compartment into the cathode compartment and combine with available anions to form an alkali metal salt, wherein the electrolytic cell is maintained at a temperature in the range of 25 to 110° C.

18. An electrolytic cell comprising:

a NaSICON membrane separating a cathode compartment and an anode compartment, wherein the cathode compartment comprises a cathode and the anode compartment comprises an anode and wherein the cathode and the anode are electrically connected to a source of electric potential;

a catholyte comprising a quantity of aluminum chloride dissolved in a solvent disposed in the cathode compartment at a temperature in the range of 25 to 110° C.;

an anolyte comprising a quantity of sodium ions disposed in the anode compartment;

wherein the source of electric potential electrolyzes the cell and causes sodium ions to pass through the NaSICON membrane from the anode compartment into the cathode compartment, wherein the source of electric potential electrolytically reduces aluminum ions and causes aluminum metal to plate onto the cathode, and wherein sodium ions combine with chloride ions to form sodium chloride.

* * * * *